United States Patent [19]

Abu-Shumays et al.

[11] Patent Number: 4,586,713

[45] Date of Patent: May 6, 1986

[54] STAR PRISM PUZZLES

[76] Inventors: Ibrahim K. Abu-Shumays; Mary D. Abu-Shumays, both of 1248 Varner Rd., Pittsburgh, Pa. 15227

[21] Appl. No.: 687,167

[22] Filed: Dec. 28, 1984

Related U.S. Application Data

[63] Continuation-in-part of Ser. No. 604,941, Apr. 27, 1984, abandoned, which is a continuation-in-part of Ser. No. 394,869, Jul. 2, 1982.

[51] Int. Cl.[4] ..... A63F 9/08

[52] U.S. Cl. ..... 273/153 S

[58] Field of Search ..... 273/153 S

[56] References Cited

U.S. PATENT DOCUMENTS 4,378,116 3/1983 Rubik ..... 273/153 S

FOREIGN PATENT DOCUMENTS 170062 12/1977 Hungary ..... 273/153 S 55-3956 1/1980 Japan ..... 273/153 S

OTHER PUBLICATIONS

P. G. Continental Advertisement, Playthings, Aug. 1981, p. 42.

*Primary Examiner*—Anton O. Oechsle

*Attorney, Agent, or Firm*—William J. Ruano

[57] ABSTRACT

This invention introduces a family of N-pronged (N=3,4,5,6, . . . ) star-based right prism puzzles which generalizes puzzles of the "Rubik's" Cube and "Pyraminx" tetrahedron class and of the class of puzzles given in the reference cited. Main features and examples of the puzzles are briefly described. Each N-pronged star-based right prism puzzle is comprised of three layers of predominantly right prism component pieces; each layer is bounded between two planes parallel to the bases of said star-based right prism. The middle layer of component pieces is comprised of a core central part surrounded by N right prism edge component pieces. The core central part is comprised of rod axes of rotation emanating from the center of each puzzle, N rod axes of rotation uniformly distributed in a plane parallel to the bases of the right prism puzzle and two rod axes of rotation pointing in opposite directions orthogonal to the bases of the right prism puzzle. Each of the N right prism edge component pieces is adjoined by a spring mechanism to, and is restricted to freely rotate in place around one of the rod axes which are parallel to the bases of the puzzle. Each surface of a puzzle is to be initially assigned a unique color or picture. The mechanism of motion makes it possible to rotate the individual component pieces of a puzzle in groups around any of the rod axes emanating from the center of the puzzle. Various possible rotations (twists and turns) result in mixing up the surface configurations. The object and the challenge is to restore the various surfaces of a puzzle into their original form, or to perform twists and turns that would result in alternate interesting external designs.

7 Claims, 14 Drawing Figures

STAR PRISM PUZZLES

This is a continuation in part of application Ser. No. 604,941, filed Apr. 27, 1984, abandoned, which in turn was a continuation in part of application Ser. No. 394,869, filed July 2, 1982.

BACKGROUND OF THE INVENTION

1. Field of the Invention

This invention relates to a family of cubic class puzzles having an overall shape of right prisms and having bases (prism parallel faces) in the form of stars. Each puzzle is comprised of various pieces which rotate in groups relative to each other in such a way as to alter the surface configurations. The object and the challenge is to perform twists and turns aimed at restoring the surfaces to their original configuration or to other interesting configurations.

2. Description of the Prior Art

This invention generalizes the "Rubik's" Cube (Rubik's Cube is a registered trademark of Ideal Toy Corporation), "Pyraminx" tetrahedron ("Pyraminx" is a registered trademark of Tomy Corporation), and similar cubic puzzles. This invention introduces a variety of shapes, wide range of challenges, and ease of assembly.

SUMMARY OF THE INVENTION

This invention introduces a class of star puzzles wherein each puzzle in this class is a right prism with a star base and with three layers of component pieces. Variations of the external shapes are also contemplated.

All the puzzles introduced here are of the cubic class whereby the surface configurations can be altered by twists and turns and the challenge is to restore the surfaces to the original configuration or to form other interesting surface designs. The overall shapes, number of visible external pieces, degree and variety of challenge or internal operational mechanisms are improvements and extensions to those for existing puzzles.

No mention is made here of the material to construct these puzzles. It may be plastic, wood, metal, etc., or a combination of different material. Spring support and ball bearings to stabilize the rest positions and enhance the quality of motion is desirable as is now standard. Since these items are not new, they are not discussed further.

Exact dimensions are not mentioned, since this is a relative matter and can be varied. Relative dimensions are provided where essential.

PRELIMINARY DISCUSSION

The preferred embodiments of this invention were described above to have overall shapes of right prisms. The concept of right prisms and some notation useful in this specification are defined here for clarity. A prism is a solid polyhedron figure with (a) two faces, referred to as bases, in the form of identical polygons which lie in parallel planes and with (b) all other faces referred to as side faces being parallelograms. A prism is said to be a right prism if and only if its bases are orthogonal (perpendicular) to all of its other faces; said other faces, referred to here as side faces, become rectangles in this case. The line joining the geometric centers of the bases of the prism is defined here as the axis of the prism, and it is noted that this axis of the prism is parallel to all of said side faces of the prism. For convenience it will be assumed in this specification that the prisms are oriented so that the prism axis and the prism side faces lie in vertical planes and that the prism bases (parallel faces) lie in horizontal planes. The star puzzles of the preferred embodiments have basic overall shapes which are right prisms whose bases (also referred to as top and bottom faces) are polygons in the form of stars; a star prism puzzle is referred to here as an N-pronged star, an N-point star or N-star if its bases are polygons in the form of a star with N prongs (N pointed projecting parts).

BRIEF DESCRIPTION OF THE DRAWINGS

The following drawings illustrate examples of the basic shapes which are the subject of this invention.

FIG. 1 is a collection of perspective views of four samples of star puzzles.

For the N-star puzzle, the component pieces corresponding to FIG. 2*b* would be right prisms with regular N-sided polygon bases.

Figure 2A:
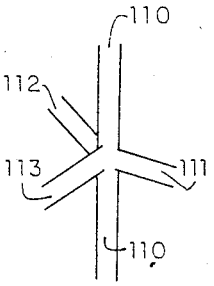
FIG. 2*a* shows 2 vertical axes of rotation 110 lying in opposite directions along the prism axis and shows 3 horizontal axes 111, 112, 113 of rotation corresponding to the central core part of the 3-pronged star puzzle of FIG. 1*a*.
Figure 2B:
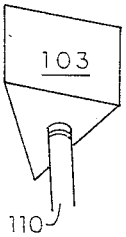
FIG. 2*b* shows the top or bottom center piece 103 for the 3-pronged star puzzle of FIG. 1*a;* this center piece 103 is a right triangular prism with equilateral triangle bases; the right prism 103 is joined at the center of its unexposed base by a spring mechanism to and is allowed to freely rotate in place around its axis 110. The number of horizontal axes 111, 112, 113 corresponding to FIG. 2*a* increases to N for the N-star puzzle (N=3,4,5,6, . . . )
Figure 2C:
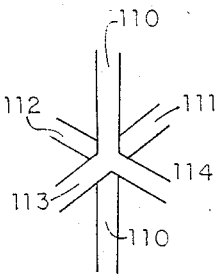
FIG. 2*c* is an example corresponding to the core central part of the puzzle of FIG. 1*b*. The horizontal axes in FIG. 2*a*, and those N horizontal axes corresponding to the N-star puzzle are uniformly distributed in a horizontal plane parallel to the bases and passing through the geometric center of the prism puzzle.
Figure 2D:
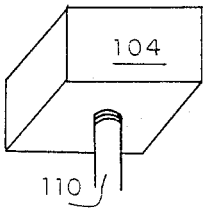
FIG. 2*d* is an example corresponding to the top or bottom center component piece 104 of the puzzle of FIG. 1*b*.
Figure 2E:
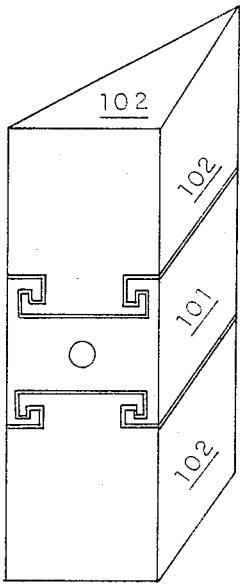
FIG. 2*e* is a perspective view of a typical group of component pieces 102, 101, 102 stacked above each other as shown in FIGS. 1*a–d*. These component pieces 102, 101 are predominantly right prisms with identical triangular bases.
Figure 2F:
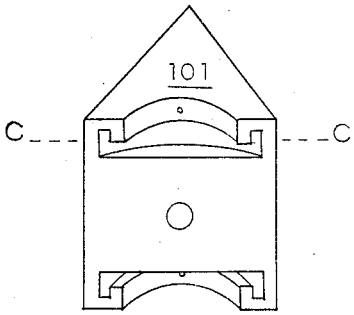
FIG. 2*f* is a perspective view showing the essentially right prism component piece 101 with partial cylindrical grooves carved around the unexposed edges of this prism 101.
Figure 2G:
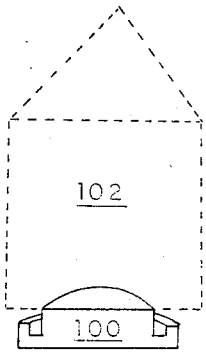
FIG. 2*g* shows in dotted lines a perspective view of a typical corner right prism component piece 102 and shows in solid lines the knob 100 which extends the right prism component piece 102 and which fits in and can move smoothly in and out of the groove in edge center component pieces 101.

The two smallest circles in FIG. 2*f* represent two ball bearings or protrusions aimed at stabilizing the rest positions; and these structures have corresponding indentations in the knobs 100 of FIG. 2*g*. The largest circle in FIG. 2*f*, also shown in FIG. 2*e*, indicates the end of an axis of rotation 111, 112, 113, etc., and the end of a spring mechanism joining the edge center component piece 101 to the core central part of the puzzle.

Figure 1A:
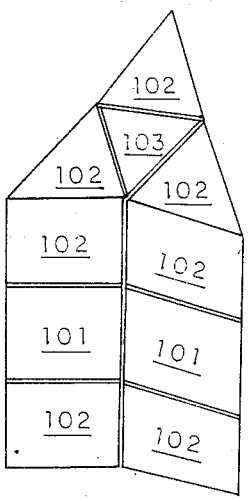
FIG. 1*a* is a view of a three-pronged (three-point) based star puzzle. The exposed face of the puzzle component piece 103 of FIG. 1*a* is an equilateral triangle.
Figure 1B:
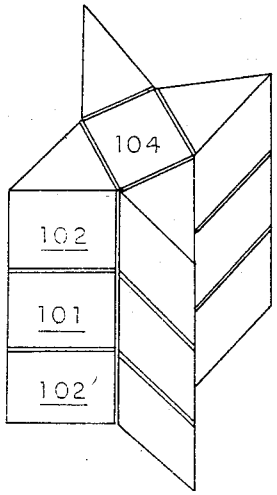
FIG. 1*b* is a view of a four-pronged (four-point) based star puzzle. The exposed face of the puzzle component piece 104 of FIG. 1*b* is a square.
Figure 1C:
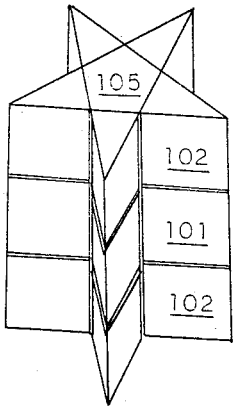
FIG. 1*c* is a view of a five-pronged (five-point) based star puzzle. The exposed face of the puzzle component piece 105 of FIG. 1*c* is a regular pentagon.
Figure 1D:
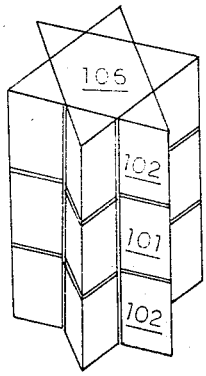
FIG. 1*d* is a view of a six-pronged (six-point) based star puzzle. The exposed face of the puzzle component piece 106 of FIG. 1*d* is a regular hexagon.
Figure 2H:
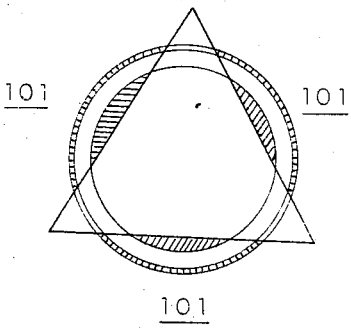
FIG. 2 is a perspective and cross-sectional view of the internal structure and of component pieces of sample star puzzles.

FIGS. 2*h, i* show parts of horizontal cross-sectional views of FIGS. 1*a* and 1*d* corresponding to locations c . . . c shown in FIG. 2*f*. The shaded parts correspond to cross-sections in FIGS. 2*h, i* corresponding to the typical knobs 100 of FIG. 2*g*. The arcs of cirles inside the triangle in FIG 2*h* and inside the hexagon in FIG. 2*i* do not exist in reality but are drawn to exhibit locations of the knobs 100 as these knobs move as a result of turns around the prism axis. It is noted in particular in connection with FIGS. 2*f–i* that the grooves in the edge center component pieces 101 are parts of cylindrical surfaces with cylindrical axes coinciding with the prism axis.

Figure 2I:
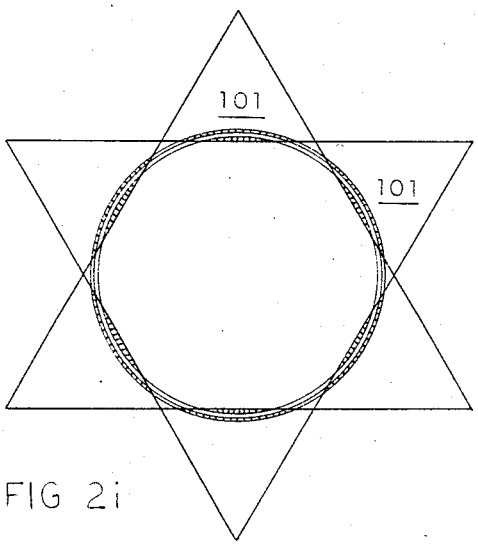

It is to be noted that the outer circular arcs corresponding to the circular part of the knob 100 in FIGS. 2*g–i* must be longer than the corresponding arcs in FIGS. 2*h, i* between adjacent component pieces 101.

It is to be noted that the flat edge of the knob 100 is in the same plane as the corresponding side face of component piece 102 as in FIGS. 2*e* and 2*g*.

Figure 3:
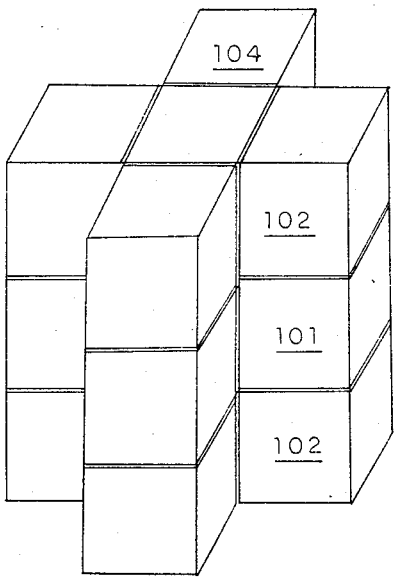

FIG. 3 corresponds to FIG. 1*b* with the overall shape of the prism corner and edge component pieces 102, 101, 102 being altered to rectangular in place of triangular right prisms. This is an example which illustrates the generality that can be achieved in the present invention by altering the external shapes of the various component pieces to result in various external puzzle shapes. The alteration of the shapes should be such as to continue to allow possible rotations of groups of pieces 102, 101, 102 around a horizontal axis.

DESCRIPTION OF THE PREFERRED EMBODIMENTS

Other objects and advantages of this invention will become more apparent from a study of the description of the drawings given above and from the additional description given below. For convenience, a double line notation is adopted in FIGS. 1*a–c* and FIG. 3 to indicate separation of adjacent component pieces and also to indicate borders of planes of rotation of component pieces. Double lines in FIG. 2*e* are also used to indicate separation of component pieces.

In some sense, the Rubik's 3×3×3 Cube and the 2×2×2 Cube are of prism type. These cubes permit rotations around six axes emanating from their centers of gravity, namely the local plus and minus x-axes, plus and minus y-axes, and plus and minus z-axes. The number of axes of rotation can be changed to yield puzzles with new configurations as is accomplished in this invention.

The prism puzzles of the preferred embodiments are the N-pronged star-based right prism puzzles shown in FIGS. 1*a,b,c,d*, and 3 having 5,6,7 and 8 axes of rotation. Rotations of groups of component pieces around vertical planes (parallel to prism axis) and horizontal planes (parallel to prism bases) are allowed. Proper rotations of component pieces 102,101,102 along vertical planes of FIGS. 1*a–d* are multiples of 180 degrees.

Each right prism puzzle of this invention, as in the examples in FIGS. 1–3, is comprised of a core central part surrounded by puzzle component pieces which have predominantly right prism shapes. The core central part is comprised of the following N+2 rod axes pivots emanating from the center of the puzzle: (i) two identical rod axes pivots 100 pointing in opposite directions along the prism axis (the prism axis is the line joining the geometric centers of the prism parallel bases), and (ii) N identical rod axes pivots 111, 112, etc., uniformly distributed in a plane orthogonal to the puzzle prism axis (parallel to the prism bases).

The puzzle component pieces are stacked in three layers; each layer is bounded by two planes parallel to the bases of the right prism. For illustration, it is assumed here that the prism bases lie in horizontal planes and the prism axis lies in a vertical plane. Each of the top and bottom layers of component pieces is comprised of a prism base-center component piece surrounded by N prism corner component pieces 102. The prism base-center component piece is a right prism with N-sided regular polygon bases such as 103, 104, 105, 106, etc. The prism base-center component piece is mounted by a spring mechanism along the center of its unexposed base to one of the rod axes pivots 110 and is restricted to rotate freely in place in a horizontal plane around that rod axis 110. The prism corner component pieces are predominantly right prisms which are identical to each other, and which have the same height as a prism base-center component piece. One side face of each prism corner component piece has the same size as and is situated abutting a side face of a prism base-center component piece. The preferred shape of each right prism corner component piece is a triangular prism; however any other right prism of the appropriate size and shape is acceptable as long as the combined base of the prism base-center component piece and any single one of the corner component pieces 102 forms a convex plane figure.

The middle layer of component pieces is comprised of N identical right prism edge component pieces 101 each having the same base as a typical base of a corner component piece 102. Each edge component piece 101 is mounted at the center of its unexposed side face to one of the rod axes 111, 112, etc., and is restricted to rotate freely in place in a vertical plane around that axis.

In the rest reference positions, as in FIGS. 1*a–d* and FIG. 3 each edge component piece 101 is situated between two corner component pieces 102 to form a long right prism 102-101-102. The combination of edge pieces have cylindrical indentations forming grooves such as shown in FIG. 2*f*. The vertical cross-section of each groove has the form of a forward or a backward letter J. The axis of the circular grooves is the same as the prism axis. Each corner component piece 102 has a knob 100 which fits in and can move freely in and out of a groove in an adjacent edge piece 101. Ball bearings or combinations of hemi-spherical knobs and indentations at central points in the groove or the knobs 100 are desirable in order to stabilize the rest positions. Such ball bearings or combinations of hemi-spherical knobs and indentations would also be desirable between the prism base-center component pieces and adjacent puzzle edge component pieces 102.

Each base-center component piece can rotate together with all of its adjacent corner pieces 102, in a horizontal plane around a rod axis 110. The knobs and grooves have to be of the right size in order to prevent disassembly of the puzzle component pieces during such a rotation.

Each edge component piece 101 can rotate together with its two adjacent corner pieces 102 in a horizontal plane around a horizontal axis 111, 112, etc. The combination of knobs and grooves serves to prevent disassembly in this case.

The preferred embodiments are those shown in FIGS. 1*a–d* and 3 discussed above.

It is suggested here that each external pair of adjacent vertical faces of the overall puzzle be initially assigned the same unique color or identification.

While we have illustrated and described several embodiments of our invention, it will be understood that these are by way of illustrating only and that various changes, extensions and modifications may be contemplated in this invention and within the scope of the following claims.

We claim:

1. In a geometrical puzzle having the general shape of a large right prism, comprised of a core central part surrounded by exactly 3N+2 puzzle component pieces, where N is at least 3 (N=3, 4, 5, 6, etc.;

said core central part is comprised of N+2 fixed rod axes pivots emanating from the center of the puzzle; two of said N+2 fixed rod axes pivots point in opposite directions along the prism axis of said larage right prism (the prism axis being the line joining the geometric centers of the prism parallel bases), the remaining N of said N+2 fixed rod axes pivots are uniformly distributed in a plane passing through the geometric center of and being parallel to the bases of said large right prism;

said 3N+2 puzzle component pieces are initially stacked in three layers, each layer is bounded by two planes parallel to the bases of said large right prism; each of two layers of component pieces shares a base of said large right prism and is comprised of a puzzle base-center component piece surrounded by N puzzle corner component pieces of said right large prism; said puzzle base-center component piece is a right prism with N-sided regular polygon bases with one of its bases being along a base of said large right prism; said puzzle base-center component piece is mounted by a spring mechanism along the center of its unexposed base to one of the rod axes pivots lying along the prism axis; said puzzle base-center component piece is restricted to rotate freely in place around its prism axis; said N puzzle corner component pieces are predominantly right prisms which are identical to each other, and which have the same height as the height of said puzzle base-center component piece, one side face of each of said corner component pieces has the same size as and is initially situated abutting a side face of said puzzle base-center component piece; the shape of the bases of each of said N puzzle corner component pieces being such that in the initial position the combined base of the prism formed from said puzzle base-center component piece and any single one of said N puzzle corner component pieces forms a convex plane figure;

the remaining layer of component pieces is a middle layer of component pieces comprised of N identical predominantly right prism puzzle edge component pieces each having the same base as a base of each of said N puzzle corner component pieces; each puzzle edge component piece has one unexposed side face situated orthogonal to and being mounted at its center and fixed to one of said remaining N of said N+2 fixed rod axes pivots; each puzzle edge component piece is restricted to rotate freely in place around that rod axis pivot fixed to its unexposed side face;

initially each puzzle edge component piece is situated between two puzzle corner component pieces to form a long right prism; the puzzle edge component pieces together have cylindrical indentations with varying cylindrical radii forming internal edge grooves, the cross-section of each internal edge groove having the form of a forward or a backward letter J; in the initial position, the axes of the cylindrical grooves are the same as the prism axis of said large right prism; each puzzle corner component piece has a knob which fills, fits in and can move freely in and out of a groove in an adjacent puzzle edge component piece;

each puzzle base-center component piece can rotate around its prism axis together with all of its N adjacent corner pieces, the rotation being in a plane parallel to the bases of said large right prism; proper rotations in this case are in multiples of 360/N degrees; the knobs in the puzzle corner component pieces and the grooves in the puzzle edge component pieces must be large enough to prevent disassembly of the puzzle component pieces during such rotations;

each puzzle edge component piece can rotate together with its two adjacent puzzle corner component pieces in a plane parallel to the prism axis of said large right prism; proper rotations in this case are in multiples of 180 degrees; also the combination of knobs and grooves serves to prevent disassembly in this case;

at least selected pairs of surfaces of-said puzzle component pieces which coincide with each other in a rest position between rotations are initially modified at their centers by a combination of a small hemi-spherical knob on one and the same size hemi-spherical indentation on the other, the hemi-spherical knobs being identical to each other and being situated on surfaces of puzzle component pieces which are restricted to rotate in place, the corresponding hemi-spherical indentations being identical to each other and being situated on surfaces of the puzzle component pieces which migrate from place to place as a result of rotations; hemi-spherical knobs and indentations serve to stabilize the rest positions between admissible rotations;

admissible rotations alter the relative positions of the puzzle component pieces and alter any initial external surface designs; the object and the challenge is to perform additional rotations to recover said initial external surface designs and to arrive at other new and interesting surface designs.

2. A puzzle as recited in claim 1 wherein N=3 and wherein the puzzle corner and the puzzle edge component pieces are all predominantly right triangular prisms.

3. A puzzle as recited in claim 1 wherein N=3 and wherein the puzzle corner and the puzzle edge component pieces are all predominantly right rectangular prisms.

4. A puzzle as recited in claim 1 wherein N=4 and wherein the puzzle corner and the puzzle edge component pieces are all predominantly right triangular prisms.

5. A puzzle as recited in claim 1 wherein N=4 and wherein the puzzle corner and the puzzle edge component pieces are all predominantly right rectangular prisms.

6. A puzzle as recited in claim 1 wherein N=5 and wherein the puzzle corner and the puzzle edge component pieces are all predominantly right triangular prisms.

7. A puzzle as recited in claim 1 wherein N=6 and wherein the puzzle corner and the puzzle edge component pieces are all predominantly right triangular prisms.

* * * * *